US006371736B1

(12) United States Patent
Froeschl et al.

(10) Patent No.: US 6,371,736 B1
(45) Date of Patent: Apr. 16, 2002

(54) PROCESS AND APPARATUS FOR PRE-FILLING A FUEL SYSTEM IN A VEHICLE

(75) Inventors: Joachim Froeschl, Herrsching; Ulrich Schlachetzki, Munich, both of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/522,398

(22) Filed: Mar. 9, 2000

(30) Foreign Application Priority Data

Mar. 9, 1999 (DE) ..... 199 10 331

(51) Int. Cl.[7] ..... F04B 49/00; F04B 19/24; F02M 37/04

(52) U.S. Cl. ..... 417/279; 417/53; 123/497

(58) Field of Search ..... 123/497, 495, 123/179.4; 417/279, 53

(56) References Cited

U.S. PATENT DOCUMENTS 5,175,663 A 12/1992 Iwabuchi et al. ..... 361/152
5,572,964 A 11/1996 Cogneville et al. .... 123/179.17

FOREIGN PATENT DOCUMENTS

| | | |
|---|---|---|
| DE | 32 38 191 | 4/1984 |
| DE | 32 46 658 | 6/1984 |
| DE | 36 38 369 | 5/1987 |
| DE | 44 02 588 | 8/1994 |
| DE | 44 17 592 | 11/1994 |
| DE | 195 48 278 | 6/1997 |
| JP | 58-204957 | 11/1983 |
| JP | 3-18659 | 1/1991 |
| JP | 3-206347 | 9/1991 |
| JP | 6-159176 | 6/1994 |
| JP | 6-173806 | 6/1994 |

*Primary Examiner*—Charles G. Freay
*Assistant Examiner*—Michael K. Gray
(74) *Attorney, Agent, or Firm*—Crowell & Moring LLP

(57) ABSTRACT

A method and apparatus for first filling a fuel system in a motor vehicle equipped with at least two operating elements as well as a fuel pump delivering the fuel is provided. For simplifying the first filling, the method and apparatus operates the fuel pump for filling the fuel system when a simultaneous actuation of the at least two operating elements provided in the vehicle occurs.

20 Claims, 2 Drawing Sheets

PROCESS AND APPARATUS FOR PRE-FILLING A FUEL SYSTEM IN A VEHICLE

BACKGROUND AND SUMMARY OF THE INVENTION

This application claims the priority of German Application No. 199 10 331.3, filed Mar. 9, 1999, the disclosure of which is expressly incorporated by reference herein.

The invention relates to a method for initially filling a fuel system in the case of a motor vehicle having at least two operating elements as well as a fuel pump delivering the fuel.

For the pre-filling of a fuel system in the case of a motor vehicle after its manufacturing process, it is necessary to trigger the fuel pump for several seconds. This triggering is conventionally caused by a bridging of the fuel pump relay.

It is also known to trigger the engine timing unit to operate the fuel pump by way of a tester. The tester is connected externally and issues a diagnostic command.

However, during or after the manufacturing of the vehicle, the above-mentioned methods require certain application and setup expenditures which cause additional costs.

With respect to related documents, reference is made to German Patent document DE 32 46 658 A1, in which a device is described for starting and switching-off motor vehicle engines having automatic transmissions.

It is an object of the present invention to provide a method and apparatus by which the first filling of the fuel system can take place in a simple manner and at reasonable cost.

This object is achieved by a method for pre-filling a vehicle fuel system. The vehicle has at least two operating elements as well as a fuel pump for delivering the fuel. By the simultaneous actuation of the at least two operating elements existing in the vehicle, an operation of the fuel pump is triggered for filling the fuel system.

Accordingly, in the case of the method of the invention, at least two operating elements already present in the vehicle are actuated simultaneously. As the result of this actuation, an operation of the fuel pump is triggered for filling the fuel system, particularly for filling the fuel lines.

Suitable operating elements are, for example, the accelerator pedal and the brake pedal. However, as an alternative, other combinations of operating elements existing in the vehicle can also be selected. The decisive fact is only that no additional equipment has to be used for triggering the first filling. Additional setup costs can therefore be avoided.

In the case of conventional engines, a microprocessor-based engine timing unit is preferably provided in which the above-described method can be implemented by means of software. If electric control commands are already used in the case of the corresponding operating elements (for example, for the accelerator pedal and the brake pedal), the method according to the invention can be implemented at no cost via a purely software solution.

Preferably, it should be possible to operate the fuel pump only when the ignition is switched on and/or when the engine is switched off. This prevents an unintentional filling from taking place in a preceding vehicle production step, for example, when the vehicle is almost completely assembled and the accelerator pedal and the brake pedal are operated unintentionally and simultaneously.

Another measure for preventing an unintentional filling when the accelerator pedal and the brake pedal are selected as operating elements is provided in that the fuel pump is operated only if the accelerator pedal and the brake pedal respectively are completely depressed.

Since the present case relates to an initial or pre-filling of a motor vehicle, the inventive activation of the fuel pump during the entire life of the vehicle should be possible only a limited number of times, particularly only once. As an alternative, the activation of the fuel pump may be permitted only in a defined range of operating hours or kilometers. As another alternative, the fuel pump can be activated only once during a driving cycle.

If only a limited number of such fuel fillings are provided, a reset possibility can be provided so that the possibilities of the fuel filling can also be utilized after or during a stay in a repair shop.

So that the fuel pump will not be triggered for an unnecessarily long time, a limiting of the triggering time of the fuel pump is preferably provided (for example, 20 seconds).

In order to prevent a dry operation of the fuel pump, it should preferably not be possible to operate this fuel pump as long as no fuel flows around it. In the case of a fuel pump arranged in the fuel tank, the filling of the fuel tank can be checked for this purpose by means of a sensor. As an alternative, it is possible to monitor the operating data of the fuel pump. For example, on the basis of its current consumption or its rotational speed, conclusions can be drawn concerning a dry operation.

In addition, a pump advance is to be prevented, which is generally carried out in the case of an "ignition on" signal. For this purpose, the fuel pump operation can be blocked for as long as there is no first filling. To this extent, the present method for the first filling acts like an initialization.

Other objects, advantages and novel features of the present invention will become apparent from the following detailed description of the invention when considered in conjunction with the accompanying drawings.

DETAILED DESCRIPTION OF THE DRAWING

Figure 1:
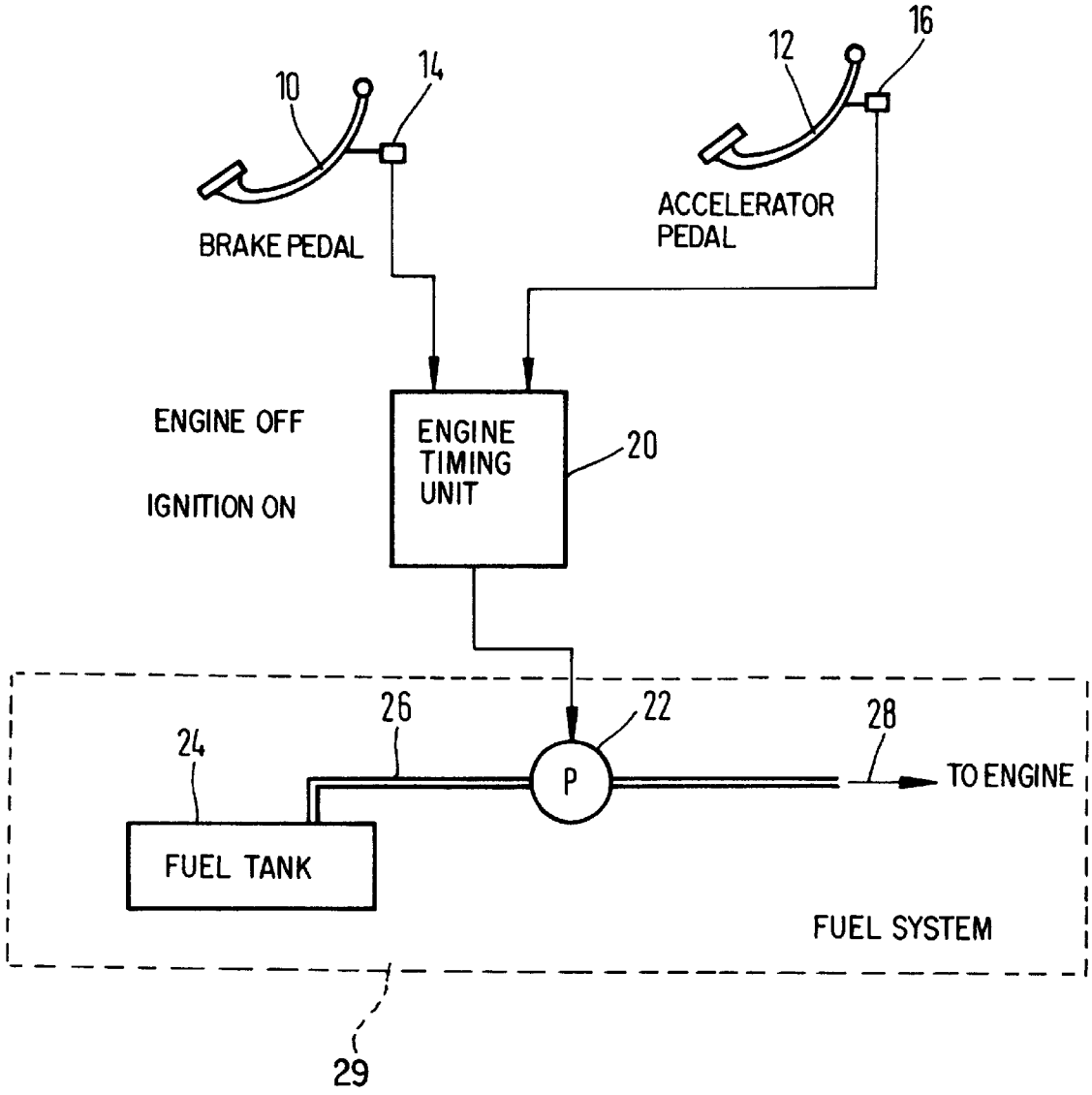
FIG. 1 is a block diagram schematically illustrating the apparatus for performing the method according to the present invention.

FIG. 1 schematically shows an embodiment of the method according to the invention. In this case, a brake pedal 10 as well as an accelerator pedal 12 are provided, which pedals can be operated by a driver. The operation of both pedals 10 and 12 is detected by means of sensors 14 and 16 in a conventional manner. The sensors 14 and 16 supply a corresponding signal to an engine timing unit 20. The engine timing unit 20 conventionally processes the information received from the pedals 10 and 12.

The engine timing unit 20 triggers a pump 22, among other components, which is arranged in a fuel line 26 (or, as an alternative, in a fuel tank 24) in order to deliver fuel from the fuel tank 24 in the direction of the engine (arrow 28).

The engine timing unit 20 comprises a software component, which permits the operating of the fuel pump 22 once during the life of the vehicle when the vehicle ignition is switched on and the two pedals 10 and 12 are simultaneously completely depressed while the engine is stopped. In this case, the fuel pump 22 is operated for approximately 20 seconds so that the whole fuel system 29, thus, the fuel lines, the fuel filter, etc, is filled with fuel.

In addition, it is possible to reset the engine timing unit 20 by way of an external diagnostic unit (not shown), which can be connected to the vehicle, such that as the result of another actuation of the two pedals 10 and 12, another activation of the fuel pump can take place. This is of interest, for example, when the vehicle is repaired in a repair shop and the fuel system must be filled again.

Figure 2:
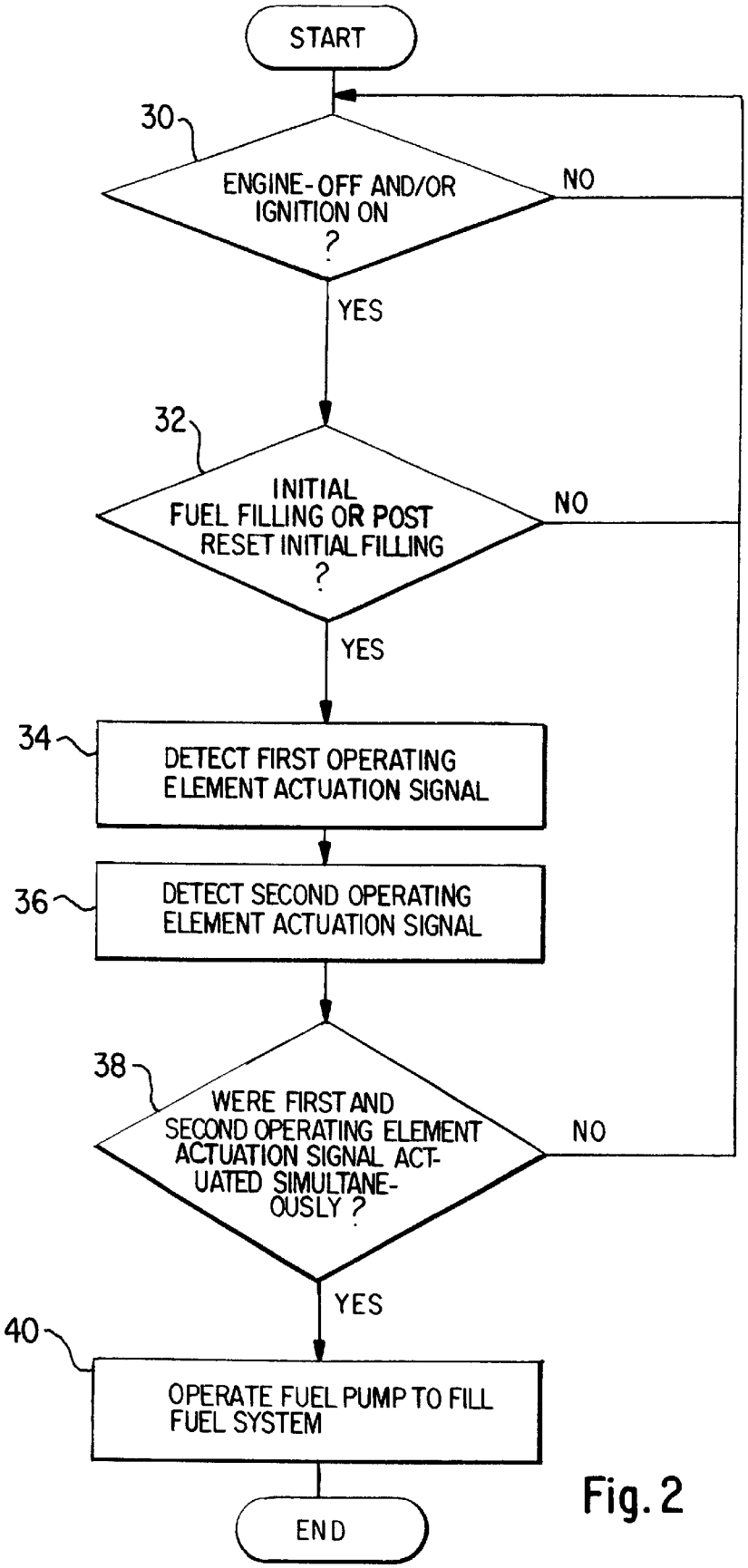
FIG. 2 is a flow chart illustrating the method for pre-filling a vehicle fuel system according to the invention.

FIG. 2 is a flow chart illustrating the method for pre-filling a fuel system in a vehicle according to the invention. At step 30, the method determines whether the engine is off and/or the ignition is on. If yes, then the method determines at step 32 whether an initial fuel filling or post reset initial filling is to occur. If yes, then the method detects first and second operating element actuation signals at steps 34 and 36. At step 38, the method determines whether the first and second operating element actuating signals were actuated simultaneously. If yes, then the method operates the fuel pump to pre-fill the fuel system at step 40.

The present method according to the invention permits a simple first filling of a fuel system 29 at reasonable cost. Additional expenditures during the manufacturing in the form of additional setup expenditures can be avoided. Furthermore, a simple operation is ensured. In addition to the use in manufacturing, the method of the invention can also be used in customer service.

Naturally, it is also possible to use a simultaneous activation of operating elements existing in the vehicle as an initialization possibility or as an activation signal for other operations. This may then also save possible additional equipment costs.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for pre-filling a fuel system in a vehicle equipped with at least two operating elements and a fuel pump, the fuel pump being arranged in the fuel system to deliver fuel, the method comprising the acts of:

simultaneously actuating the at least two operating elements in the vehicle; and based on the simultaneous actuation, operating the fuel pump to fill an otherwise empty fuel system in the vehicle.

2. The method according to claim 1, wherein the act of operating the fuel pump occurs only when an engine of the vehicle is switched-off.

3. The method according to claim 1, wherein the act of operating the fuel pump occurs only when an ignition of the vehicle is switched-on.

4. The method according to claim 2, wherein the act of operating the fuel pump occurs only when an ignition of the vehicle is switched-on.

5. The method according to claim 1, wherein said at least two operating elements are an accelerator pedal and a brake pedal.

6. The method according to claim 5, wherein the act of simultaneously actuating the at least two operating elements requires that the brake pedal and accelerator pedal be completely depressed.

7. The method according to claim 1, wherein the act of operating the fuel pump can only be performed a limited number of times during a life of the vehicle.

8. The method according to claim 7, wherein the limited number of times is once.

9. The method according to claim 1, wherein the act of operating the fuel pump only occurs within a defined range of operating hours or distance travelled of the vehicle.

10. The method according to claim 1, wherein the act of operating the fuel pump occurs only once during a driving cycle.

11. The method according to claim 1, wherein the act of operating the fuel pump occurs only for a limited time period.

12. The method according to claim 6, wherein the act of operating the fuel pump occurs only for a limited time period.

13. The method according to claim 7, wherein the act of operating the fuel pump occurs only for a limited time period.

14. The method according to claim 9, wherein the act of operating the fuel pump occurs only for a limited time period.

15. The method according to claim 1, further comprising the act of blocking operation of the fuel pump as long as the simultaneous actuation of the at least two operating elements does not occur.

16. The method according to claim 1, further comprising the act of blocking the operation of the fuel pump as long as said fuel pump is operating dry.

17. The method according to claim 16, further comprising the act of determining whether said fuel pump is operating dry via at least one of a fuel tank filling sensor and operational data on said fuel pump.

18. A system for pre-filling a vehicle fuel system, comprising:

at least two operating elements already existing in a vehicle;

a control unit receiving input signals from said at least two operating elements;

a fuel pump arranged in the vehicle fuel system and being operatively coupled with the control system, said fuel pump delivering fuel from a fuel tank in the vehicle to an engine of the vehicle; and wherein said control system comprises means for activating said fuel pump to initially fill the fuel system with fuel from the fuel tank when said at least two operating elements are simultaneously actuated.

19. The system according to claim 18, wherein said at least two operating elements are an accelerator pedal and a brake pedal.

20. A software product for pre-filling a vehicle fuel system, comprising a computer readable medium having stored thereon program code segments that:

detect a simultaneous actuation of at least two operating elements existing in a vehicle; and signal an activation of a fuel pump arranged in the fuel system of the vehicle to perform a pre-filling of the fuel system when the simultaneous actuation of the at least two operating elements occurs.

* * * * *